US008347660B2

(12) United States Patent
Guenther

(10) Patent No.: US 8,347,660 B2
(45) Date of Patent: Jan. 8, 2013

(54) PADLOCK

(75) Inventor: Raymond Guenther, Wuppertal (DE)

(73) Assignee: Abus August Bremicker Soehne KG, Wetter-Volmarstein (DE)

( * ) Notice: Subject to any disclaimer, the term of this patent is extended or adjusted under 35 U.S.C. 154(b) by 0 days.

(21) Appl. No.: 13/414,080

(22) Filed: Mar. 7, 2012

(65) Prior Publication Data

US 2012/0167641 A1 Jul. 5, 2012

Related U.S. Application Data

(63) Continuation of application No. 12/397,553, filed on Mar. 4, 2009.

(30) Foreign Application Priority Data

Mar. 7, 2008 (DE) ..... 10 2008 012 994

(51) Int. Cl.
*E05B 67/02* (2006.01)

(52) U.S. Cl. ..... 70/52; 70/40; 70/48; 70/55; 70/417

(58) Field of Classification Search ..... 70/40, 48, 70/52, 54–56, 417
See application file for complete search history.

(56) References Cited

U.S. PATENT DOCUMENTS

| | | | | |
|---|---|---|---|---|
| 4,998,423 | A * | 3/1991 | Hsu | 70/40 |
| 5,755,121 | A * | 5/1998 | Crass | 70/52 |
| 5,921,123 | A * | 7/1999 | Schwarzkopf et al. | 70/371 |
| 5,987,940 | A * | 11/1999 | Chang | 70/38 A |
| 6,305,198 | B1 * | 10/2001 | Chastain et al. | 70/40 |

* cited by examiner

*Primary Examiner* — Suzanne Barrett
(74) *Attorney, Agent, or Firm* — Harness, Dickey & Pierce, P.L.C.

(57) ABSTRACT

A padlock is provided that may include a lock body and a hoop which is movable between an open position and a closed position with respect to the lock body. The lock body may include an inner housing, an outer housing and a latching mechanism for latching the hoop in the closed position. The inner housing may include a first insertion part and a second insertion part which may receive the latching mechanism to form a pre-installable module. The pre-installable module may be inserted between first and second shells of the outer housing in shape matched manner to place the padlock in a fully assembled condition.

21 Claims, 6 Drawing Sheets

PADLOCK

CROSS-REFERENCE TO RELATED APPLICATIONS

This application is a continuation of U.S. patent application Ser. No. 12/397,553 filed on Mar. 4, 2009, which claims the benefit and priority of German Patent Application No. DE 10 2008 012 994.1, filed Mar. 7, 2008. The entire disclosures of the above applications are incorporated herein by reference.

BACKGROUND AND SUMMARY

The present disclosure relates to a padlock having a lock body and a hoop which is movable between an open position and a closed position with respect to the lock body, with the lock body having an outer housing and a latching mechanism in the outer housing for the latching of the hoop in the closed position.

The hoop is non-releasably connected to the lock body in such a padlock. In the unlatched state, the hoop can, however, be moved between the open position and the closed position. In the closed position, the hoop and the lock body together form a closed loop, for example to secure two chain links to one another. The hoop can be latched in the closed position by means of the latching mechanism to prevent an unauthorized opening. The latching mechanism typically includes a lock cylinder which is rotatably actuated by means of a matching key. The latching mechanism can additionally include a driver and/or a latch.

A particularly tamper-proof kind of such padlocks is represented by so-called ring hoop padlocks in which the hoop has the form of an open ring and is rotatably supported at the lock body around an actuation axis of the latching mechanism (in particular the axis of rotation of the lock cylinder). Such a ring hoop padlock is known from EP 0 872 615 B1 whose content is included in the disclosure content of the present application, in particular with respect to the structure and the general operation of such a ring hoop padlock, even if the lock cylinder of the padlock in accordance with the invention is not necessarily replaceable, as is described in EP 0 872 615 B1.

It is known for a padlock of the explained kind to provide a front plate and a rear plate within the outer housing which are connected to one another to form a rigid arrangement via a plurality of riveted on pins, said arrangement in turn being welded to the outer housing at a plurality of points. This rigid arrangement allows the fastening of the further components of the padlock, in particular of the latching mechanism. The assembly of such a padlock is, however, undesirably complex and/or expensive.

It is an object of the invention to simplify the manufacture of a padlock of the explained kind.

This object is satisfied by a padlock including a lock body that has an inner housing which is formed by a front insertion part and a rear insertion part which are inserted into the outer housing in shape matched manner and which accept the latching mechanism in at least partly shape matched manner, with the front insertion part and/or the rear insertion part forming a respective unitary, three-dimensionally structured part.

The lock body of the padlock in accordance with the invention has an inner housing which is formed by a front insertion part and a rear insertion part. The front insertion part or the rear insertion part is made as a unitary, three-dimensionally structured part. These two parts are preferably each three-dimensionally structured. This means that the front insertion part or the rear insertion part is not only structured along its plane of extent with respect to its outline (for example in the form of a metal plate having a specific contour in an x direction and a y direction). The front insertion part or the rear insertion part rather also has a structure, i.e. a varying outline, along its thickness (z direction). The front insertion part or the rear insertion part is thus not a purely plate-like structure, but rather a three-dimensional body. The front insertion part or the rear insertion part is in this respect each made in one piece. This is possible in a simple manner in a technical production respect, for example, in that the front insertion part or the rear insertion part forms a casting part—in particular an injection molded part. An embodiment as a zinc die casting is particularly advantageous, for example. An embodiment of plastic is, however, also possible.

The front insertion part and the rear insertion part, which together form the named inner housing, are inserted into the outer housing of the lock body in shape matched manner. The inner space of the outer housing is hereby substantially filled up by a three-dimensionally structured inner housing—to the extent that it is not take up by the hoop and the latching mechanism and is also not needed for the respective movement path of the moving parts of the lock. The latching mechanism of the lock is inserted into this inner housing—that is into the front insertion part and the rear insertion part, with the front insertion part and the rear insertion part surrounding the latching mechanism in partly or even fully shape matched manner. The latching mechanism is hereby fixed in a precise location in the lock body as soon as the outer housing is also finally installed.

The inner housing is—as explained—in two parts. It is hereby possible to insert the respective parts of the latching mechanism and optionally of the hoop into the inner housing. The two parts of the inner housing (front insertion part and rear insertion part), the latching mechanism and in particular also the hoop thus form a pre-installable unit, with the individual components of this unit not necessarily having to be permanently fastened to one another. The final fixing of the different components of the named unit relative to one another can rather only take place by the final installation of the outer housing, for example by welding a front shell and a rear shell of the outer housing to one another, i.e. the components of the named pre-installable unit are captured in shape matched manner in the outer housing by the final installation of the outer housing.

An advantageously simple manufacture of the padlock hereby results. Fewer fastening steps are in particular necessary. For example, no connection pins have to be riveted to fix individual plates of the inner housing to one another. It is also not necessary to weld different parts of the inner housing and of the outer housing to one another or to fix them to one another non-releasably in another manner. Due to the three-dimensionally structured design of the inner housing, it is namely possible to realize a reliable shape matching between the inner housing and the latching mechanism and also between the inner housing and the outer housing so that a clearance-free fit is also achieved without welding or other fastening measures. A self-centering of the inner housing can even be achieved by corresponding mold inclinations so that ultimately a higher fit precision is achieved than with a permanent connection between the inner housing and the outer housing (for example by welding) which does not allow any subsequent correction of the relevant positions.

An even higher tamper-proofing can also be achieved by the three-dimensionally structured inner housing since the latching mechanism cannot only be surrounded by the outer housing, but rather also practically at all sides by the inner housing.

In accordance with a preferred embodiment, the front insertion part has at least one rear side section and the rear insertion part has at least one front side section, said sections contacting one another areally. The inner housing—despite the two-part embodiment—hereby has a particularly stable structure even if the front insertion part and the rear insertion part are not permanently connected to one another (for example by riveting or by welding). The handling of the front insertion part and of the rear insertion part is hereby also simplified on the manufacture of the lock and in particular on formation of a pre-installed assembly which also already includes the latching mechanism.

It is also particularly advantageous with respect to the installation of the padlock if the front insertion part and the rear insertion part are connected to one another in shape matched manner. Pre-installation steps can namely hereby be carried out without it being necessary to connect the front insertion part and the rear insertion part non-releasably to one another by additional measures (e.g. by riveting or welding). A shape matching of the two named parts of the inner housing is also of advantage with respect to a possible attempt to break open since a displacement of the front insertion part and of the rear insertion part relative to one another is prevented.

Such a shape match between the front insertion part and the rear insertion part can be realized in a particularly simple and effective manner if the front insertion part has at least one rear engagement projection which engages into a front-side engagement mount of the rear insertion part. A cam which engages into a recess of the rear insertion part made in complementary manner can, for example, be formed at the front insertion part.

Alternatively or additionally, the rear insertion part can have at least one front-side engagement projection which engages into a rear-side engagement mount of the front insertion part in order hereby to establish the explained shape matching between the front insertion part and the rear insertion part.

It is furthermore preferred if the front insertion part and the rear insertion part are inserted loosely into the outer housing. As already explained above, no additional installation steps are thus necessary to fix the inner housing relative to the outer housing.

To ensure a fit of the inner housing in the outer housing which is as free of clearance as possible, it is preferred if the outer housing has a front wall section (e.g. front shell) and a rear wall section (e.g. back shell), with the front insertion part and the rear insertion part together having a thickness which corresponds to the clear spacing between the front wall section and the rear wall section of the outer housing.

To achieve a clearance-free fit of the inner housing in the outer housing without additional fastening measures, it is furthermore of advantage if the named front wall section of the outer housing has a recess into which the front insertion part engages in shape matched manner and if the named rear wall section of the outer housing has a recess into which the rear insertion part engages in shape matched manner. The inner housing can hereby be fixed in a lateral direction relative to the outer housing, with simultaneously a centering being able to be achieved if suitable centering chamfers are formed at the named recesses.

In accordance with an advantageous embodiment, the named inner housing that is the front insertion part together with the rear insertion part—form a guide passage for the movable hoop of the padlock. The inner housing can alternatively also form such a guide passage together with the outer housing. In both cases, a smooth and clearance-free movement of the hoop is achieved in a simple manner. Since the inner housing is—as explained—composed of two parts, the inner housing can surround the hoop along a relatively large peripheral region of the hoop cross-section so that an areal contact is ensured between the inner housing and the hoop, whereby the movement of the hoop can be guided particularly easily.

The latching mechanism of the padlock can have a lock cylinder. It is particularly advantageous if this lock cylinder is surrounded partly or completely peripherally by the front insertion part and/or by the rear insertion part of the inner housing. The lock cylinder is hereby fixed rotationally fixedly and is simultaneously protected with respect to manipulation attempts from the side.

The invention will be explained in more detail in the following with reference to the drawings and to an embodiment. This embodiment relates to a ring hoop padlock in which the invention provides to be particularly advantageous, in particular with respect to a simple installation. The invention, however, also relates to other kinds of padlocks, for example to padlocks with a substantially U-shaped hoop which is linearly movable, pivotable or rotatable.

DRAWINGS

Figure 3B:
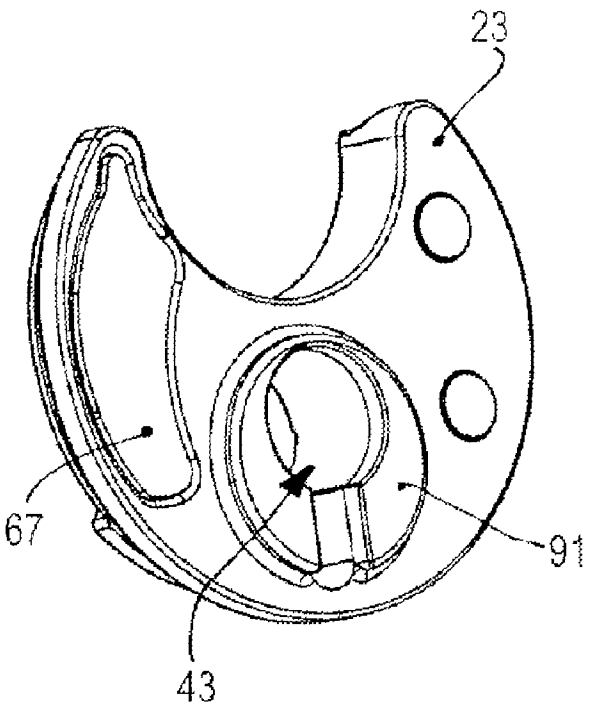
Figure 3A:
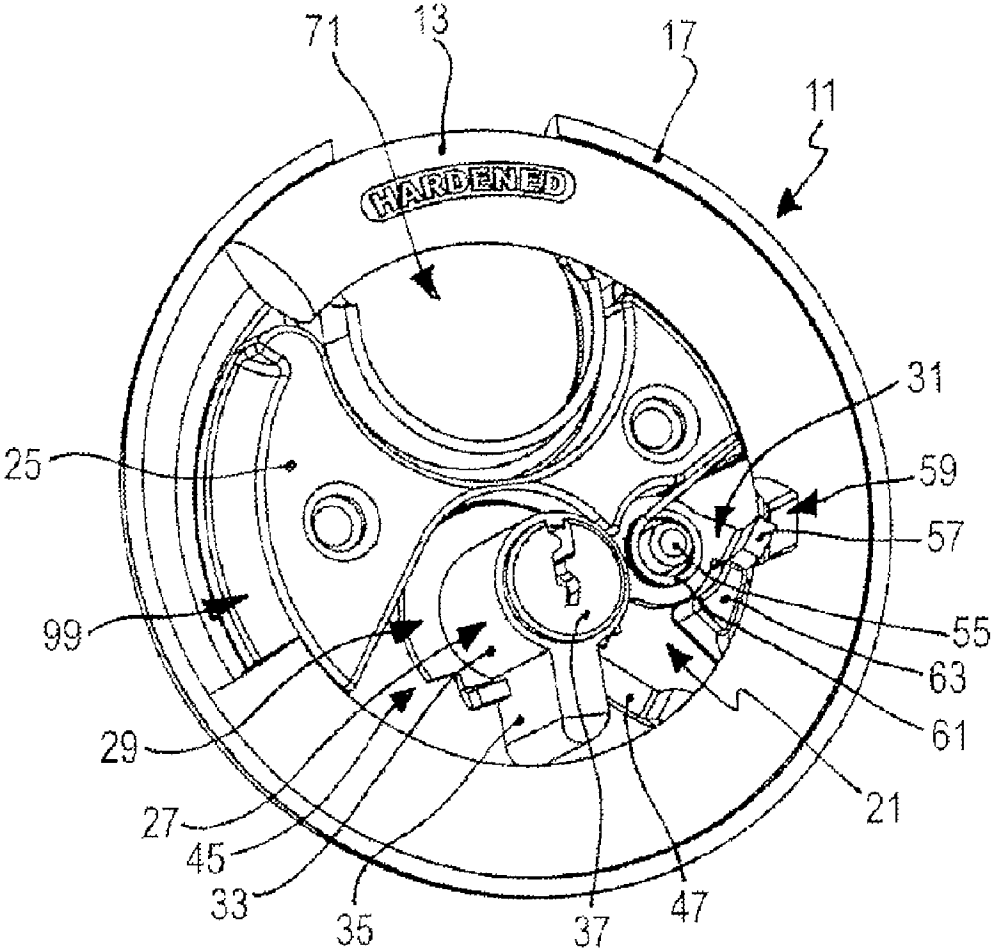
Figure 4B:
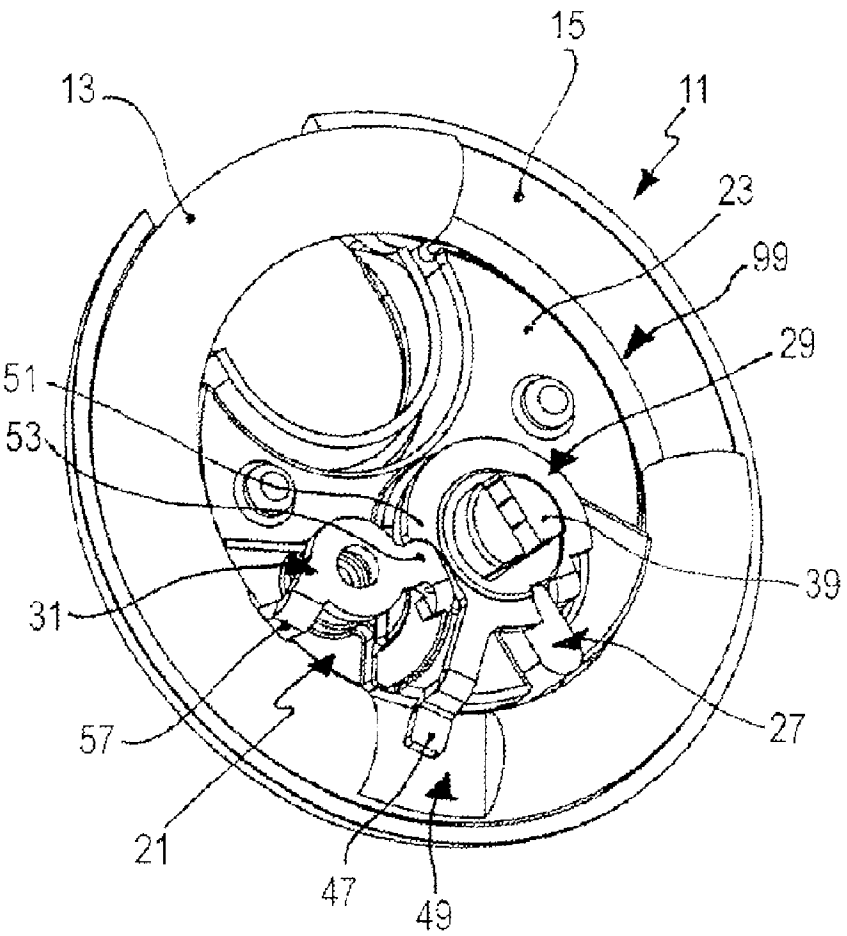
Figure 4A:
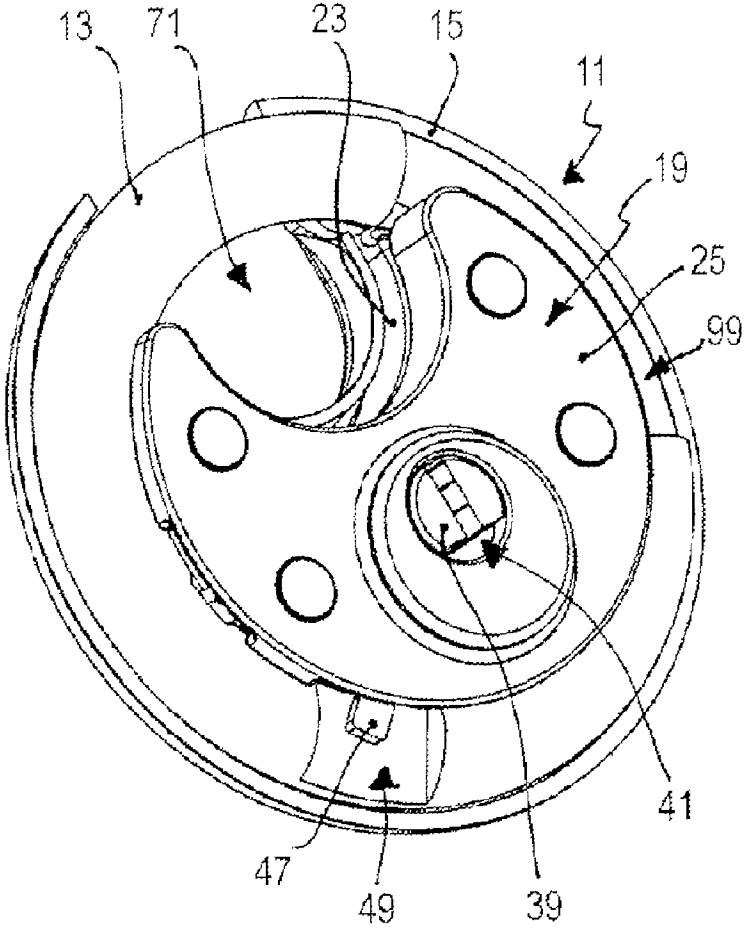
Figure 5B:
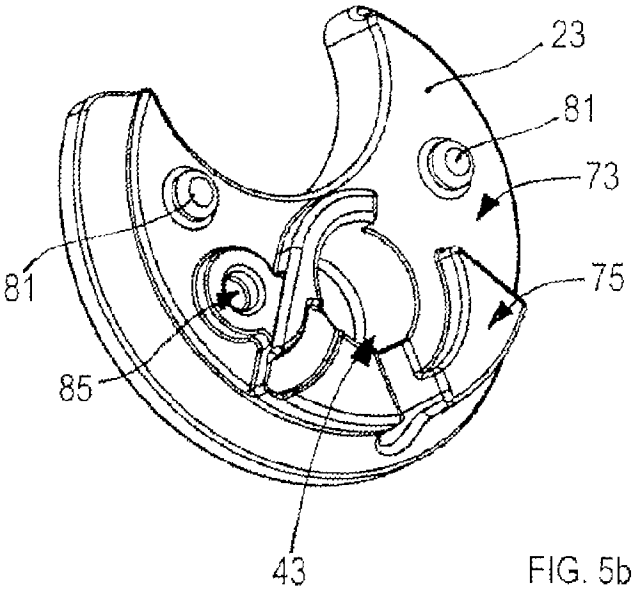
Figure 5C:
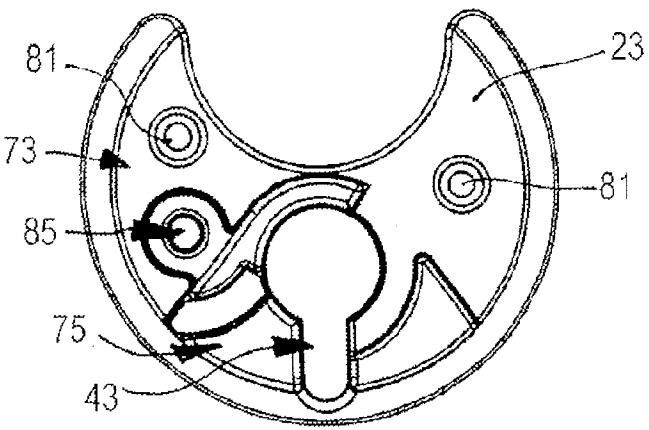
Figure 5A:
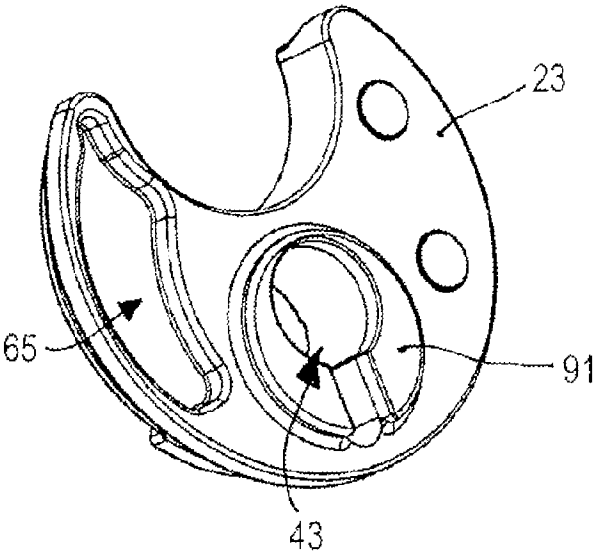
Figure 6B:
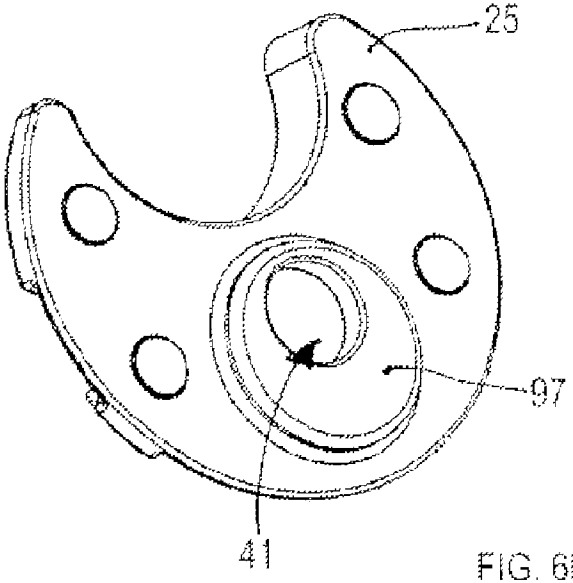
Figure 6C:
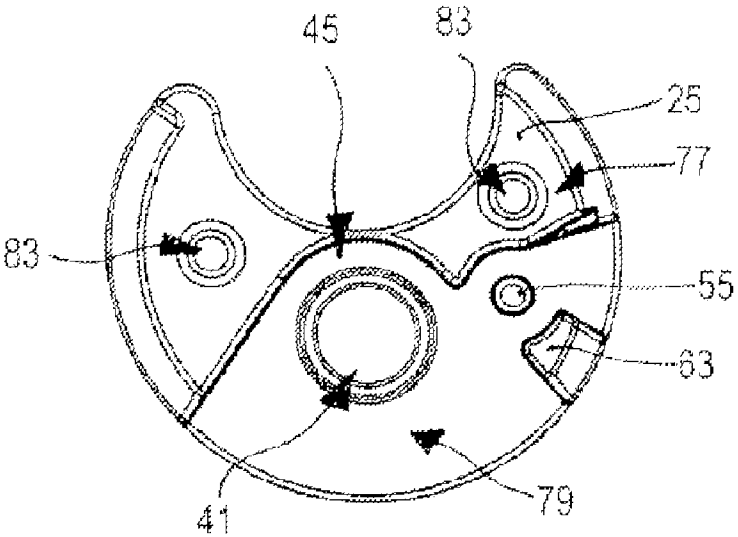
Figure 6A:
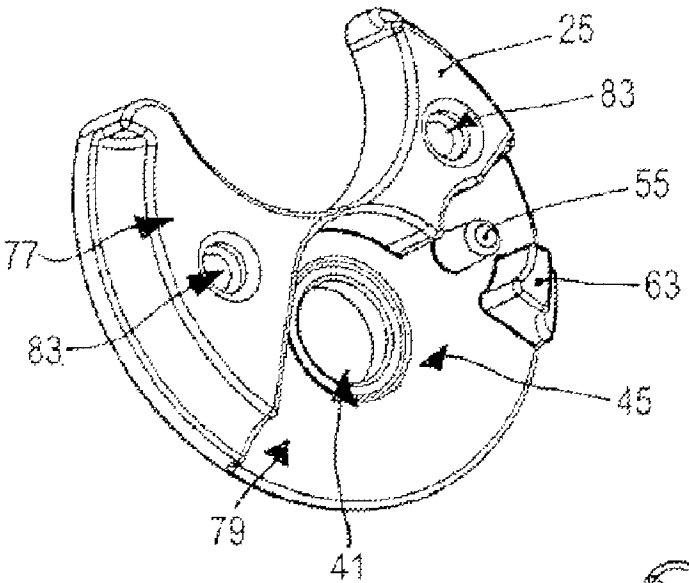
Figure 7B:
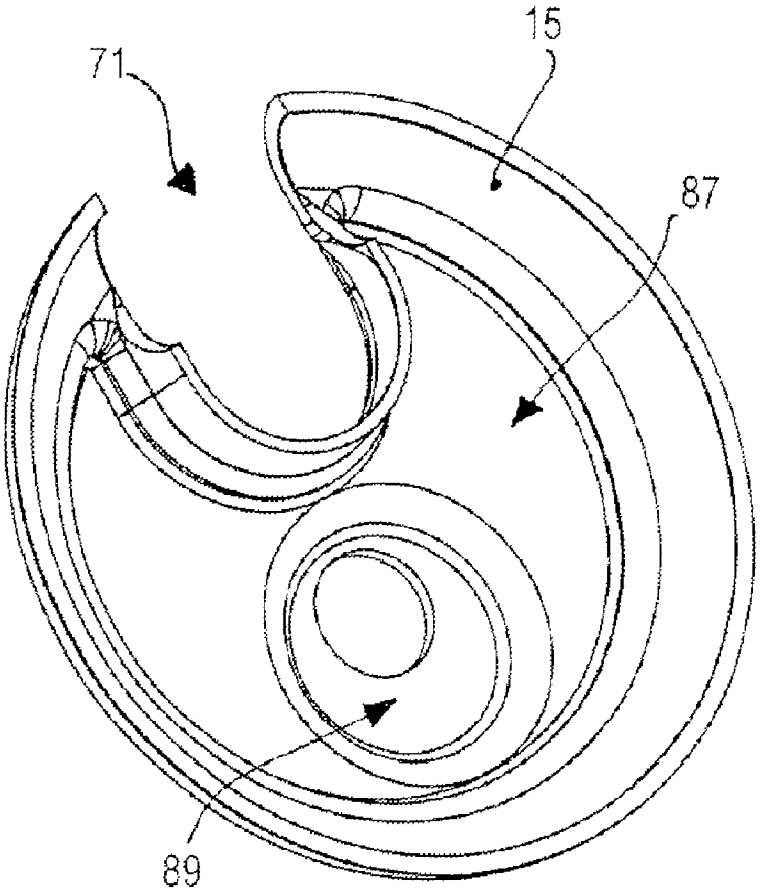
Figure 7A:
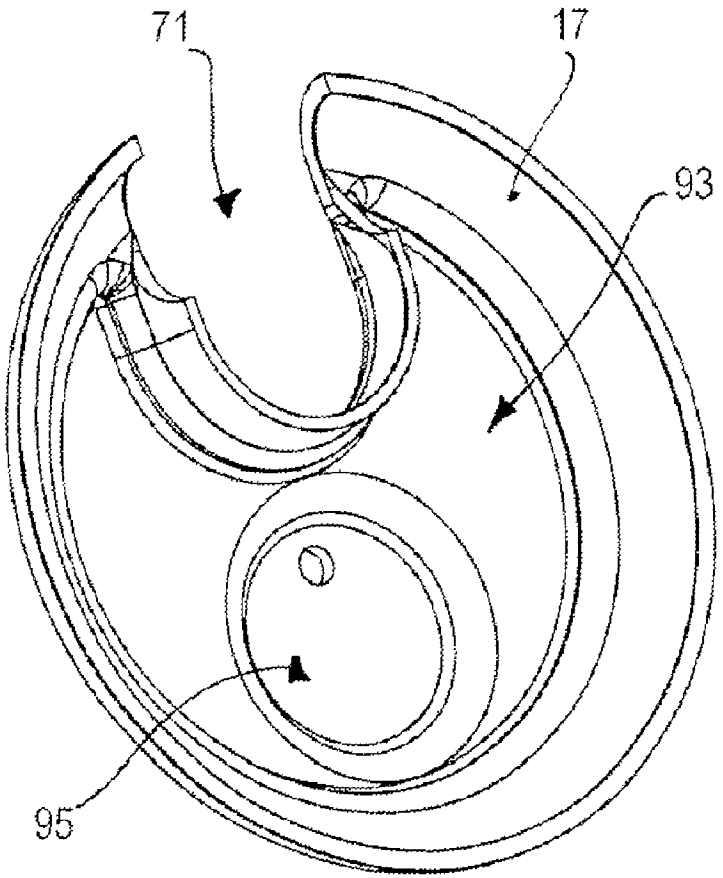

FIGS. 3*a* and 3*b* show a respective perspective front view of the lock with a removed front shell and a removed front insertion part and of the front insertion part;

FIGS. 4*a* and 4*b* show a respective perspective view of the lock with a removed rear shell of the outer housing and with an additionally removed rear insertion part of the inner housing;

FIGS. 5*a*, 5*b* and 5*c* show the front insertion part of the inner housing in a perspective front view, a perspective rear view and a rear view respectively;

FIGS. 6*a*, 6*b* and 6*c* show the rear insertion part of the inner housing in a perspective front view, a perspective rear view and a front view respectively;

FIGS. 7*a* and 7*b* show the rear shell of the outer housing in a perspective front view or the front shell of the outer housing in a perspective rear view.

DETAILED DESCRIPTION

The padlock shown in the Figures has a lock body 11 and a hoop 13 which has the shape of an open ring. The hoop 13 is rotatably supported at the lock body 11, and indeed with respect to an axis of rotation A (FIGS. 1 and 2) which simultaneously forms the axis of actuation of a latching mechanism explained in the following. The hoop 13 can thus be rotated between an open position and a closed position (FIGS. 1, 2, 3*a*, 4*a* and 4*b*).

The lock body 11 has an outer housing which is formed by a front shell 15 (FIG. 7*b*) and a rear shell 17 (FIG. 7*a*) which are welded to one another along their respective outer peripheries in the finally installed state of the padlock.

The hoop 13, an inner housing 19 and a latching mechanism 21 are received in this outer housing.

The inner housing 19 includes a front insertion part 23 (FIGS. 3*b*, 5*a*, 5*b* and 5*c*) and a rear insertion part 25 (FIGS. 4*a*, 6*a*, 6*b* and 6*c*). The latching mechanism 21 is received in the inner housing 19 and it includes a lock cylinder 27, a drive disk 29 and a securing latch 31 (FIGS. 1, 3*a* and 4*b*).

The lock cylinder 27 has a cylinder housing 33 with a web section 35 (FIG. 3*a*). A cylinder core 37 is rotatably supported in the cylinder housing 33. The cylinder core 37 has a connection appendage 39 at the rear side which has the shape of a circle segment (FIG. 4*b*). The connection appendage 39 of the cylinder core 37 engages into a circular cylinder core mount 41 of the rear insertion part 25 and is hereby rotatably supported at the rear insertion part 25 (FIG. 4*a*). The cylinder housing 33 is inserted in shape matched manner into a cylinder housing mount 43 of the front insertion part 23 of the inner housing 19, with the front insertion part 23 completely peripherally surrounding the cylinder housing 33. The cylinder housing 33 is hereby rotationally fixedly secured to the front insertion part 23 (FIGS. 3*a*, 3*b* and 4*b*).

The cylinder core 37 is rotationally fixedly coupled to the drive disk 29 via the connection appendage 39 (FIG. 4*b*). The drive disk 39 extends between the front insertion part 23 and the rear insertion part 25 of the inner housing 19, with a corresponding contact surface 45 being formed at the rear insertion part 25 in the vicinity of the cylinder core mount 41 (FIGS. 3*a*, 6*b*, 6*c*). A driver finger 47 is formed at the drive disk 29 and engages into a drive cut-out 49 of the hoop 13 (FIGS. 4*a* and 4*b*). A cam track 51 is furthermore formed at the drive disk 29.

Figure 1:
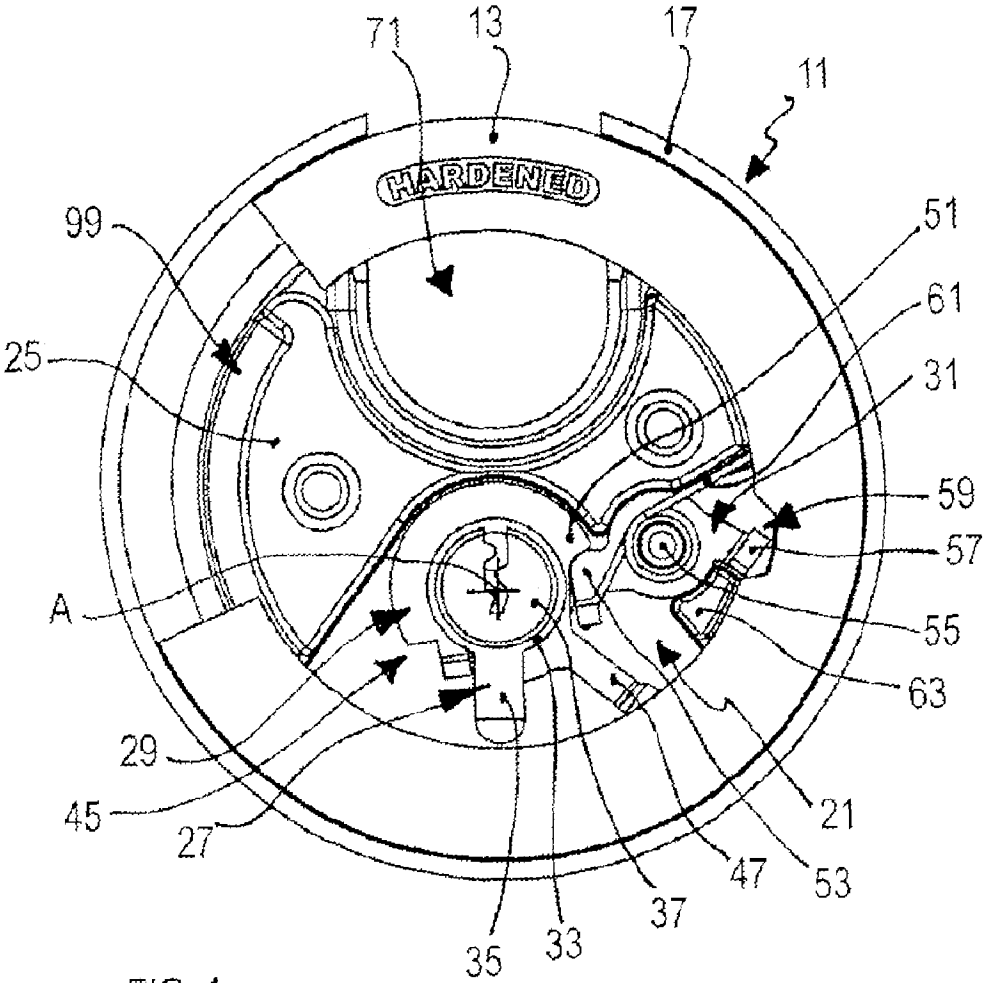
FIG. 1 shows a front view of a ring hoop padlock with a removed front shell of the outer housing and a removed front insertion part of the inner housing.

The cam track 51 cooperates with an actuation appendage 53 of the securing latch 31 (FIGS. 1 and 4*b*). The securing latch 31 is rotatably supported at a pin section 55 which is made in one piece at the rear insertion part 25 (FIGS. 1, 3*a*, 6*a* and 6*c*). The securing latch 31 has a blocking tongue 57 which engages into a securing recess 59 of the hoop 13 in the closed position of the hoop 13 (FIGS. 1, 3*a* and 4*b*). The securing latch 31 is biased by means of a spring 61 in the direction of a blocking position which is shown in FIGS. 1, 3*a* and 4*b*. In this blocking position, the blocking tongue 57 of the securing latch 31 simultaneously contacts an abutment section 63 which is formed in one piece at the rear insertion part 25 of the inner housing 19 (FIGS. 1, 3*a*, 6*a* and 6*c*).

A reinforcement plate 67 which serves as protection against sawing (FIG. 3*b*) is inserted in shape matched manner into a recess 65 at the front side of the front insertion part 23 of the inner housing 19 (FIG. 5*a*).

The padlock shown in the Figures serves in a manner known per se for the securing of two objects (for example two chain links) to one another or for the blocking of an object (for example of a chain link guided through an eye). For this purpose, the front shell 15 and the rear shell 17 of the outer housing form a substantially U-shaped mounting space 71 through which the hoop 13 passes if it is located in the closed position in accordance with FIGS. 1, 3*a*, 4*a* and 4*b*. If an attempt is made in this closed position to bring the hoop 13 forcibly into the open position (that is to rotate it clockwise with respect to the representation in accordance with FIG. 1), the associated boundary surface of the securing cut-out 59 of the hoop 13 abuts the blocking tongue 57 of the securing latch 31 which is in turn supported at the abutment section 63 of the rear insertion part 25 of the inner housing 19 (FIGS. 1 and 3*a*).

The authorized user can, however, rotate the hoop 13 into the open position in that the cylinder core 37 of the lock cylinder 27 is rotated clockwise (again with respect to the representation in accordance with FIG. 1) by means of an associated key. The drive disk 29 hereby also carries out a corresponding rotational movement, with the cam track 51 of the drive disk 29 cooperating with the actuation appendage 53 initially effecting a rotational movement of the securing latch 31 against the spring bias and thus counter clockwise (again with respect to the representation in accordance with FIG. 1). The blocking tongue 57 of the securing latch 31 is hereby pivoted out of the movement path of the hoop 13. The further rotational movement of the cylinder core 37 and of the drive disk 29 has the result that the driver finger 47 of the drive disk 29 engages at the associated boundary surface of the drive cut-out 49 of the hoop 13 (FIG. 4*b*) and hereby effects the desired rotational movement of the hoop 13 around the axis A. The hoop 13 is thus pulled back out of the mounting space 71. The closing of the shown padlock takes place in reverse order.

A special feature of the shown padlock comprises the two-part inner housing 19 which is inserted in shape matched manner into the outer housing (front shell 15 and rear shell 17) and which receives the latching mechanism (lock cylinder 27 and securing latch 31 in shape matched manner, with the front insertion part 23 and the rear insertion part 25 of the inner housing 19 each being made as a unitary, three-dimensionally structured part.

The front insertion part 23 and the rear insertion part 25 are only loosely connected to one another and together nevertheless form a stable assembly. For this purpose, the rear side of the front insertion part 23 (FIG. 5*b*) and the front side of the rear insertion part 25 (FIG. 6*a*) contact one another areally. The front insertion part 23 has a first connection surface 73 at the rear side and a second connection surface 75 which is elevated with respect to the first connection surface 73 (FIG. 5*b*). The first connection surface 73 of the front insertion part 23 cooperates with a first connection surface 77 of the rear insertion part 25 at least region-wise. The second connection surface 75 of the front insertion part 23 cooperates at least region-wise with a second connection surface 79 of the rear insertion part 25 which is set back with respect to the first connection surface 77 of the rear insertion part 25 and which includes the aforesaid contact surface 45 for the drive disk 29 (FIG. 6*a*). Due to this areal contact of the front insertion part 23 and of the rear insertion part 25, the inner housing 19 forms a stable arrangement, in particular also in event of an attempted breaking open.

In addition, a shape matching is provided between the front insertion part 23 and the rear insertion part 25. This shape matching is achieved, on the one hand, in that the aforesaid connection surfaces 73, 77, on the one hand, and connection surfaces 75, 79, on the other hand, are located at different levels (that is extend along different normal planes to the axis A), with the extent of the transition between the first connection surface 73 and the second connection surface 23 corresponding to the extent of the transition between the first connection surface 77 and the second connection surface 79 of the rear insertion part 25. On the other hand, a plurality of engagement projections 81 are formed at the rear side of the front insertion part 23 (FIG. 5*b*) which engage into associated engagement mounts 83 at the front side of the rear insertion part 25 (FIG. 6*a*). Conversely, the pin section 55 of the rear insertion part 25 (FIG. 6*a*) also engages into an associated engagement mount 85 which is formed at the rear side of the front insertion part 23 (FIG. 5*b*).

Due to this shape matching between the front insertion part 23 and the rear insertion part 25, these two parts of the inner housing 19 cannot be offset relative to one another in a direction perpendicular to the axis A as long as the inner housing 19 is captured in the outer housing (front shell 15 and rear shell 17).

Shape matching is also realized between the inner housing 19 and the outer housing. It is hereby possible that the inner housing 19 is only inserted loosely into the outer housing (front shell 15 and rear shell 17) and in this respect an exactly fitting and clearance-free fit is nevertheless ensured. For this purpose, the front shell 15 (FIG. 7*b*) has a first recess 87 at which a second recess 89 is formed. The front insertion part 23 (FIG. 5*a*) has an outline at its front side which corresponds to the outline of the first recess 87 of the front shell 15. In addition, an elevated portion 91 is formed at the front side of the front insertion part 23 and engages in shape matched manner into the second recess 89 of the front shell 15.

In a corresponding manner, the rear shell 17 has a first recess 93 at which a second recess 95 is formed. The contour of the rear side of the rear insertion part 25 (FIG. 6*b*) corresponds to the contour of the named first recess 93 of the rear shell 17 so that the explained shape matching is hereby effected. In addition, the rear insertion part 25 has an elevated portion 97 at its rear side which engages in shape matched manner into the named second recess 95 of the rear shell 17.

As can in particular be seen with respect to the elevated portions 91, 91 of the front insertion part 23 (FIG. 5*a*) or of the rear insertion part 25 (FIG. 6*b*, centering chamfers are realized for the explained shape matching which effect a self-centering of the inner housing 19 with respect to the front shell 15 or to the rear shell 17. The formation of such centering chamfers can be effected without problem since—as explained—the front insertion part 23 and the rear insertion part 25 are three-dimensionally structured parts.

Figure 2:
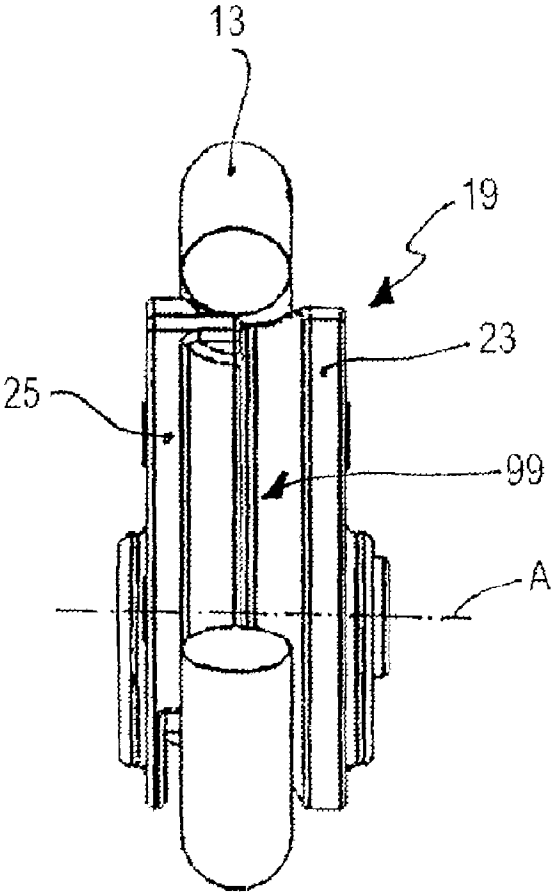
FIG. 2 shows a side view of the padlock with a removed outer housing.

Furthermore, it must still be pointed out that the front insertion part 23 and the rear insertion part 25 of the inner housing 19 form a guide passage 99 for the rotatable hoop 13 together with the front shell 15 and the rear shell 17 of the outer housing (FIGS. 1 and 2). In this respect, the hoop 13 contacts the front insertion part 23 and the rear insertion part 25 substantially areally at the radially inner side so that the hoop is guided securely and a canting or jamming of the hoop 13 in the lock body 11 is reliably avoided.

A particular advantage of the shown padlock is the simple manufacture. The front insertion part 23 and the rear insertion part 25 can in particular be produced by injection molding as unitary, three-dimensionally structured parts, for example as robust zinc die castings. Due to the two-part structure of the inner housing 19, it is possible to receive parts of the latching mechanism 21 (in particular parts of the lock cylinder 27 or of the securing latch 31) in shape matched manner in the inner housing 19 and thus to hold them securely captured in the inner housing 19, in particular also during the further installation process. It is also not necessary to fasten additional connection devices to the inner housing 19. Due to the mutual shape matching between the front insertion part 23 and the rear insertion part 25, a simple and reliable handling is possible, with the inner housing 19 forming a pre-installable assembly. Due to the shape matching between the inner housing 19 and the front shell 15 and the rear shell 17 of the outer housing, it is in turn possible to dispense with a separate fastening of the inner housing 19 relative to the outer housing. It is also sufficient with respect to the reinforcement plate 67 if it is inserted loosely into the associated recess 65 of the front insertion part 23 since the reinforcement plate 67 is captured at the front insertion part 23 on the final installation of the padlock (connection of the front shell 15 to the rear shell 17).

Finally, all the components of the inner housing 19 and of the latching mechanism 21 can be secured to one another in that the front shell 15 and the rear shell 17 of the outer housing are permanently connected to one another, for example by welding.

REFERENCE A NUMERAL LIST

11 lock body
13 hoop
15 front shell
17 rear shell
19 inner housing
21 latching mechanism
23 front insertion part
25 rear insertion part
27 lock cylinder
29 drive plate
31 securing latch
33 cylinder housing
35 web section
37 cylinder core
39 connection appendage
41 cylinder core mount
43 cylinder housing mount
45 contact surface
47 driver finger
49 drive cut-out
51 cam track
53 actuation appendage
55 pin section
57 blocking tongue
59 securing cut-out
61 spring
63 abutment section
65 recess
67 reinforcement plate
71 mounting space
73 first connection surface
75 second connection surface
77 first connection surface
79 second connection surface
81 engagement projection
83 engagement mount
85 engagement mount
87 first recess
89 second recess
91 elevated portion
93 first recess
95 second recess
97 elevated portion
99 guide passage

What is claimed is:

1. A padlock including a body portion and a hoop that is movable relative to the body portion between a locked position and an unlocked position, the body portion comprising:

a pre-installable module including an inner housing and a latching mechanism, the inner housing having first and second insertion parts that at least partially encase the latching mechanism, wherein the first and second insertion parts are not secured to each other by welding or a fastener; and an outer housing including a first shell and a second shell that engage each other along their respective outer peripheries to at least partially encase the pre-installable module to retain the padlock in a fully assembled condition, wherein the outer housing is not welded to the inner housing or the latching mechanism and the outer housing is not secured to the inner housing or the latching mechanism by a fastener.

2. The padlock of claim 1, wherein at least one of the first and second insertion parts includes an engagement projection extending therefrom and received in an aperture in the other of the first and second insertion parts prior to being retained in the fully assembled condition, thereby restricting the first and second insertion parts from being offset relative to one another in a direction perpendicular to an axis of rotation of the hoop prior to installing the inner housing into the outer housing.

3. The padlock of claim 1, wherein the pre-installable module is inserted into the outer housing in shape matched manner.

4. The padlock of claim 1, wherein the inner housing receives the latching mechanism in shape matched manner.

5. The padlock of claim 1, wherein the first insertion part and the second insertion part are loosely connected to one another in shape matched manner such that the first insertion part and the second insertion part cannot be offset relative to one another in a direction perpendicular to an axis of rotation of the hoop.

6. The padlock of claim 1, wherein the first insertion part and the second insertion part are inserted loosely into the outer housing, with a clearance-free fit being formed based on the shape matching between the outer housing and the first and second insertion parts.

7. The padlock of claim 1, wherein the inner housing and the outer housing cooperate to form a guide passage for the moving hoop.

8. The padlock of claim 1, wherein the latching mechanism has a lock cylinder which is surrounded partly or fully peripherally by at least one of the first and second insertion parts.

9. The padlock of claim 1, wherein the latching mechanism includes a latch, and one of the first and second insertion parts includes a molded pin section at which the latch is rotatably supported.

10. The padlock of claim 1, wherein the latching mechanism has a latch, and one of the first and second insertion parts includes a molded abutment section which is operative as an abutment for the latch when the hoop is moved from the closed position in the direction of the open position in a latched state.

11. A method of manufacturing a padlock comprising:

providing an inner housing including a first insertion part and a second insertion part;

providing a latching mechanism;

assembling the inner housing and the latching mechanism together to form a pre-installable module, whereby the first insertion part and the second insertion part at least partially encase the latching mechanism, wherein forming the pre-installable module includes unsecurely attaching the first and second insertion parts to each other;

providing an outer housing including a first shell and a second shell; and installing the pre-installable module into the outer housing to place the padlock in a fully assembled condition by at least partially encasing the pre-installable module between the first and second shells and welding the first and second shells to each other.

12. The method of claim 11, wherein forming the pre-installable module includes attaching the first and second insertion parts to each other without welding and without use of a fastener.

13. The method of claim 11, wherein installing the pre-installable module into the outer housing to place the padlock in the fully assembled condition includes retaining the pre-installable module in the outer housing only by encasing the pre-installable module between the first and second shells and does not include welding the outer housing to the pre-installable module or securing the outer housing to the pre-installable module by a fastener.

14. The method of claim 11, wherein the pre-installable module includes a hoop that is movable relative to the inner housing between open and closed positions.

15. The method of claim 14, wherein the hoop is substantially encased in the outer housing in the open position and is at least partially encased in the outer housing in the closed position.

16. The method of claim 14, further comprising connecting the first and second insertion parts to one another in shape matched manner such that the first and second insertion parts cannot be offset relative to one another in a direction perpendicular to an axis of rotation of the hoop.

17. The method of claim 16, wherein the first and second insertion parts are inserted loosely into the outer housing, with a clearance-free fit being formed based on the shape matching between the outer housing and the first and second insertion parts.

18. The method of claim 11, wherein the latching mechanism includes a latch, and one of the first and second insertion parts includes a molded pin section at which the latch is rotatably supported.

19. The method of claim 11, wherein the latching mechanism has a latch, and one of the first and second insertion parts includes a molded abutment section which is operative as an abutment for the latch when the hoop is moved from the closed position in the direction of the open position in a latched state.

20. The method of claim 11, wherein the inner housing receives the latching mechanism in shape matched manner.

21. The padlock of claim 1, wherein the first shell permanently fastens to the second shell by welding.

* * * * *